US007525031B2

(12) United States Patent
Fisher, IV

(10) Patent No.: US 7,525,031 B2
(45) Date of Patent: Apr. 28, 2009

(54) BILATERIAL DRUM PEDAL

(76) Inventor: Charles H. Fisher, IV, 410 Main St., Coalport, PA (US) 16627

( * ) Notice: Subject to any disclaimer, the term of this patent is extended or adjusted under 35 U.S.C. 154(b) by 470 days.

(21) Appl. No.: 11/399,347

(22) Filed: Apr. 7, 2006

(65) Prior Publication Data

US 2007/0234875 A1 Oct. 11, 2007

(51) Int. Cl.
*G10D 13/08* (2006.01)

(52) U.S. Cl. ..... 84/411 R

(58) Field of Classification Search ..... 84/421, 84/411 R

See application file for complete search history.

(56) References Cited

U.S. PATENT DOCUMENTS 1,508,390 A 9/1924 David et al.
2,484,302 A 10/1949 Laverents
3,677,128 A 7/1972 Simpson
3,988,957 A 11/1976 Escamilla
4,945,803 A 8/1990 Norwood
5,317,946 A 6/1994 Hoshino
5,994,635 A * 11/1999 Hoshino ..... 84/422.1
6,028,259 A * 2/2000 Lombardi et al. ..... 84/422.1

* cited by examiner

*Primary Examiner*—Kimberly R Lockett
(74) *Attorney, Agent, or Firm*—John S. Hale; Gipple & Hale

(57) ABSTRACT

A drum pedal assembly is constructed with a beater assembly having a base plate adapted to sit on the floor and having an outer end adapted to be juxtaposed with a drum. Upright posts are mounted on the base plate and a split shaft is mounted to an upright posts. The split shaft has a pair of coaxial shaft parts having outer ends journaled in bearings housed in the upright posts and axially juxtaposed inner ends journaled in a central support member. A drum beater is mounted on each of the coaxial shafts. The beater is driven by a pair of pedal assemblies, each provided with a pedal pivoted mounted on a separate base plate and a pair of posts having upper and lower ends mounted on the base plate. The post upper ends house bearings and a shaft is rotatably mounted in the bearings. A linkage is mounted on the pedal and is secured to a sprocket mounted on the shaft for rotation of the shaft on depression of the pedal and connector assemblies connect the pedal shaft with the beater split shaft to transmit torque to the split shaft driving the drum beater.

16 Claims, 9 Drawing Sheets

BILATERIAL DRUM PEDAL

CROSS-REFERENCE TO RELATED APPLICATIONS

There are no related applications.

TECHNICAL FIELD OF THE INVENTION

The present invention relates generally to drum pedals, and more particularly to a foot operated bilateral drum pedal of the type used to play floor standing bass drums.

BACKGROUND OF THE INVENTION

1. Field of the Invention

The present invention relates generally to drum pedals. In particular, the present invention relates to a dual foot operated drum pedal with pedal assemblies located on opposite sides of the drum beater assembly, each pedal assembly selectively operating a drum beater independently of the other pedal assembly.

2. Discussion of Background

In most contemporary musical styles ranging from classical through to jazz, pop and rock, bass drums are typically played using a foot operated pedal arrangement. A typical arrangement of this type includes a base or frame designed to rest on the flood and adapted for connection to the drum, so as to maintain the pedal and the drum in predetermined spatial relationship. The base is adapted to support a beater shaft for rotation about an horizontal axis. The beater shaft supports an elongate beater stem and a beater head is attached to the remote end of the stem. Some form of drive mechanism extends between the foot pedal and the beater shaft, such that depression of the foot pedal by the player effects rotation of the beater shaft. This in turn drives the beater head forward in an arc defined by the beater stem, so as to hit the diaphragm or skin of the drum. This arrangement leaves the drummer's hands free to play other drums and symbols.

Early arrangements of this type only made use of a single pedal activating a single beater. This limited the speed and complexity of rhythms that could be played on the drum, while leaving the player's other foot under utilized. A typical single drum beater using a pivoting pedal which drives a chain linkage connected to a beater shaft sprocket is shown by U.S. Pat. No. 5,317,946 issued to Hoshino on Jun. 7, 1994. As a result of these limitations, so-called "twin pedal" arrangements were developed, whereby both of the player's feet could be used to operate two pedals, and hence two beaters, independently.

While these twin pedal arrangements allowed more complex bass drum rhythms to be played more easily, such structures are subject to a number of inherent limitations. The first of these arises because the ideal strike zone or "sweet spot" on the drum skin is relatively small and striking the skin outside of this zone produces an inferior quality of sound. Most twin pedal devices require the beaters to be positioned apart from one another, to the extent that with the assembly centrally positioned, the beaters make contact with the drum skin on either side of the optimum strike zone, rather than hitting it directly. Furthermore the beaters are generally operated by foot pedals which require both heel and toe control from each foot.

In an attempt to address this problem, some twin pedal assemblies have positioned the beaters as closely together as possible. In many cases, however, this has necessitated spacing the foot pedals similarly closely together, which severely compromises the ergonomics from the player's perspective.

Other known twin pedal arrangements have attempted to address this difficulty, using relatively complex drive mechanisms, extended linkages and interconnecting universal joints, so as to space the pedals outwardly from the beaters. A limitation with arrangements of this type, however, is that these more complex linkage arrangements introduce flexibility and friction into the drive mechanism, both of which absorb power, reduce efficiency and compromise the sensitivity and "feel" of the system as experienced by the player. A common complaint from players in this context is that such systems feel "remote" or "disconnected". Systems of this type are also susceptible to rapid wear and failure due to the relatively high stresses imposed on the key linkages and supporting frame elements.

The modern drummer frequently relies on both his hands and feet to play a variety of different drums and other percussion instruments requiring the drummer to quickly switch back and forth from instrument to instrument. It is to the drummer's advantage to be able to spread his workload over as many limbs and muscle groups as possible to prolong his or her endurance and resist fatigue and injury and to be able to produce as many diverse combinations of sounds as possible.

A number of different foot-pedal actuated drum-beaters have been devised, each offering some advantages to the drummer. These prior art devices include those described in the following patents: U.S. Pat. No. 1,508,390 issued to Gladstone et al. on Sep. 16, 1924; U.S. Pat. No. 2,484,302 issued to Laverents on Oct. 11, 1949; U.S. Pat. No. 3,677,128 issued to Simpson on Jul. 18, 1972; U.S. Pat. No. 3,988,957 issued to Escamilla on Nov. 2, 1976; and U.S. Pat. No. 4,945,803 issued to Norwood on Aug. 7, 1990.

The '390 patent discloses a single double-acting mallet actuated by the forward depression of a foot pedal. The '302 patent uses a pair of beaters that alternately strike a single drumhead, actuated by the heel-to-toe rocking motion of the drum pedal. The '128 patent discloses a pair of mallets, each striking its own drum, actuatable respectively by the toe and heel of a single split pedal. The '957 patent shows a drum pedal assembly in which a split foot pedal operates a pair of drumsticks against a single drum head. The '803 patent similarly shows a pair of mallets that alternately strike a single drum head upon the forward depression of a single toe pedal.

While these devices have solved some problems, they suffer from various disadvantages. Some require two separate drums, which take up space that could be used for different percussion instruments. Others are limited in that the pair of mallets disclosed may only operate alternately and not independently of each other. Still others employ rough mechanical means that generate an unwelcome level of noise.

Despite the above advances, there is still a need for a foot-pedal actuated drum beater system that gives the drummer a greater variety of musical options while optimizing instrument space and minimizing muscle fatigue on the part of the drummer.

Hence, there is a need for an improved foot pedal device for playing a drum. The present invention satisfies this need.

SUMMARY OF THE INVENTION

A dual drum pedal assembly having a beater assembly with a base plate adapted to sit on the floor and having an outer end adapted to be juxtaposed with a drum. Upright posts are mounted on the base plate with the upright posts being interconnected and support by cross members. A split shaft beater shaft is mounted to the upper portion of each upright support.

The split shaft has a pair of coaxial shafts having one end journaled in a central support member which is mounted to one of the cross members and an opposite end mounted to an upright support with each coaxial shaft being able to independently rotate with respect to the other coaxial shaft. A plurality of drum beaters are mounted on the coaxial shafts with each drum beater comprising a shaft mount adjustably mounted on one of the coaxial shafts, a beater arm mounted in the shaft mount and a beater head secured to distal end of the beater arm. Pedal assemblies located on each side of the beater assembly are constructed with a pedal pivotally mounted on a separate base plate, the base plate being provided with a pair of posts having lower ends mounted on the base plate with bearings races mounted on the post upper ends and a shaft rotatably mounted in the bearing races. A flexible linkage links the pedal to a sprocket mounted on the shaft for rotation of the shaft by depression of the pedal. The pedal shaft of each pedal assembly is connected to the beater assembly by a connector assembly which connects a pedal shaft with one of the split beater shafts so that action by the pedal rotates the pedal shaft, the respective connector assembly and associated beater split shaft causing a beater mounted on the split shaft to strike an adjacent drum.

It is an object of the invention to provide a bilateral symmetrical design creating a pedal unit where both pedals feel identical to the drummer.

It is another object of the invention to provide quad drive springs to the beater split shafts for increased response and sensitivity.

It is still another object of the invention to provide a center mounting hoop clamp on the beater plate which eliminates all lateral torque on the bass drum hoop.

It is yet another object of the invention to object to offset the center mounting hoop clamp to provide easy user access.

It is another object to the invention to create an ergonomic drum centering bi-lateral drum pedal.

It is still another object of the invention to create spring loaded plate levelers and anti skid pads on both the pedal base plates and center beater.

It is yet another object of the invention to have fully adjustable concentric double chain drives which can be adjusted laterally.

It is still another object of the invention to provide independent adjustable beater holders with lateral adjustment of each beater.

It is yet another object of the invention to have beater heads with opposite end drum striking surfaces of different hardness.

It is still another object of the invention to provide a free standing pedestal design allowing for more downward travel of the pedal.

These and other objects, advantages, and novel features of the present invention will become apparent when considered with the teachings contained in the detailed disclosure along with the accompanying drawings.

DETAILED DESCRIPTION OF THE INVENTION

Figure 1:
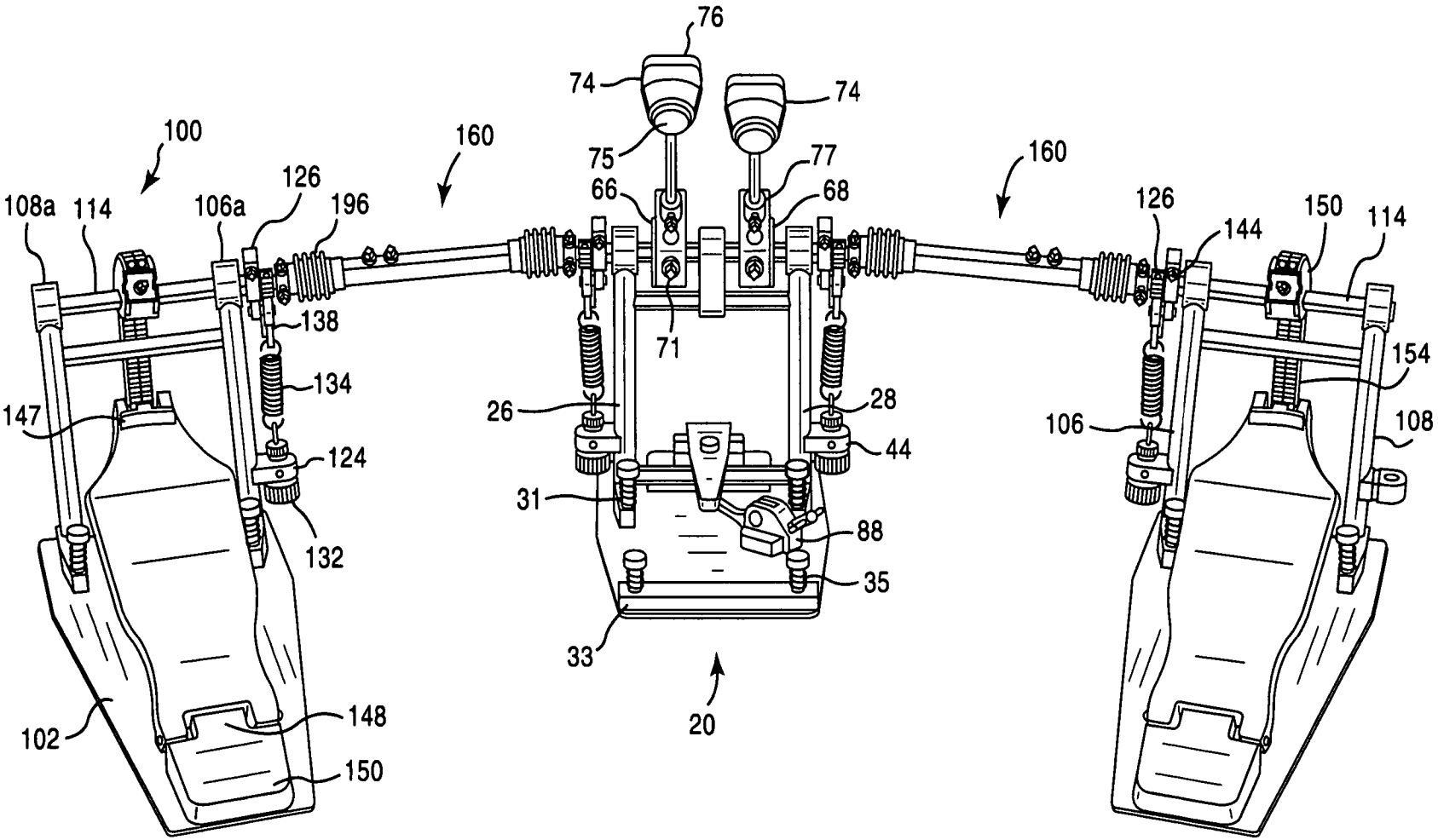
FIG. 1 is a perspective view of the dual drum pedal invention.

The preferred embodiment and best mode of the invention is shown in FIGS. 1 through 10.

The invention is directed toward a dual drum pedal assembly 10 having a beater assembly 20 which is activated and operated by pedal assemblies 100 and 101 positioned on opposite sides of the beater assembly 20. The action of the pedal assemblies 100 and 101 is transmitted to a split shaft 36/37 of the beater assembly 20 by intermediate connector assemblies 160 and 161.

Figure 2:
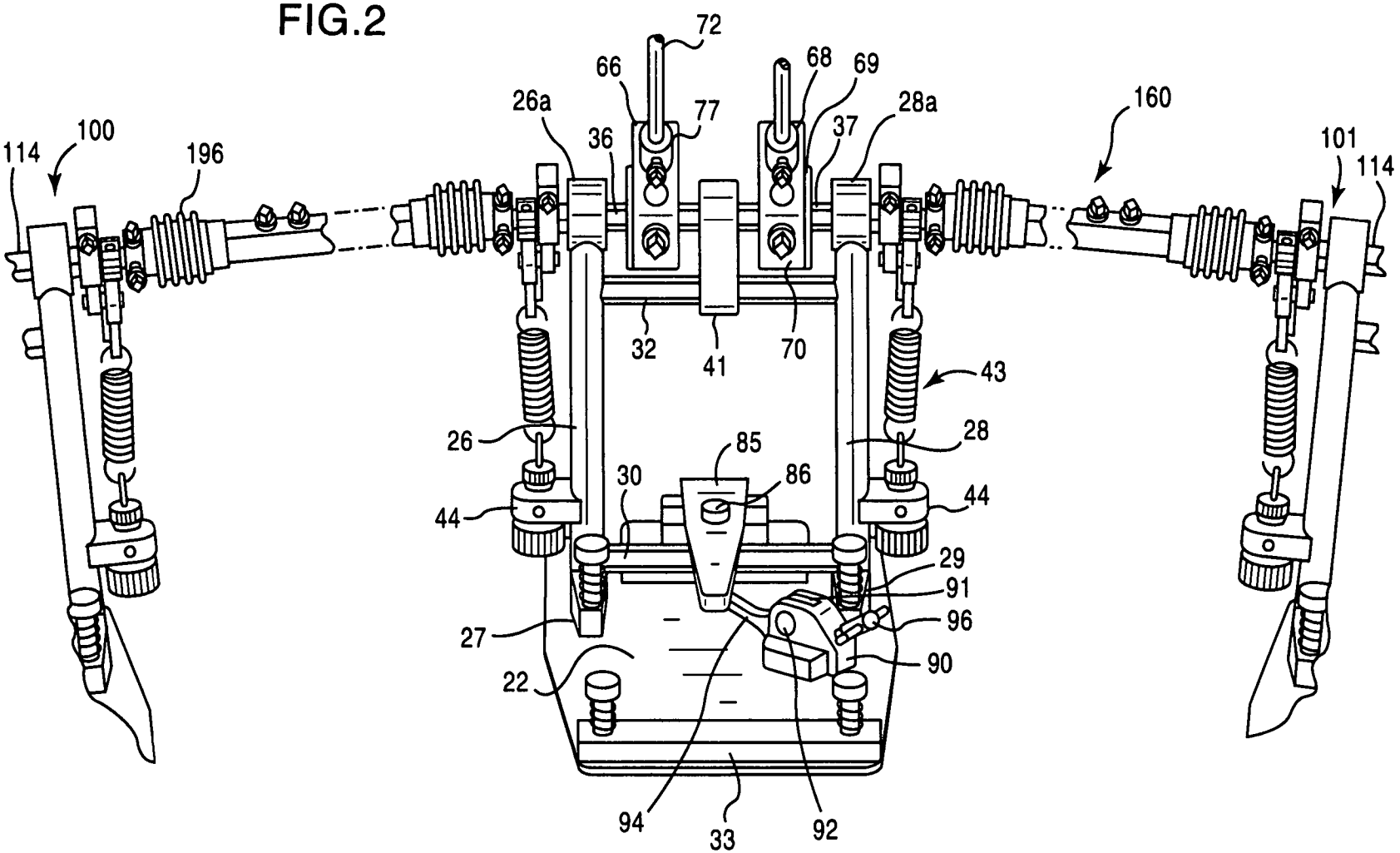
FIG. 2 is an enlarged view of the drum beater assembly and connector assemblies partially shown in phantom as shown in FIG. 1.
Figure 3:
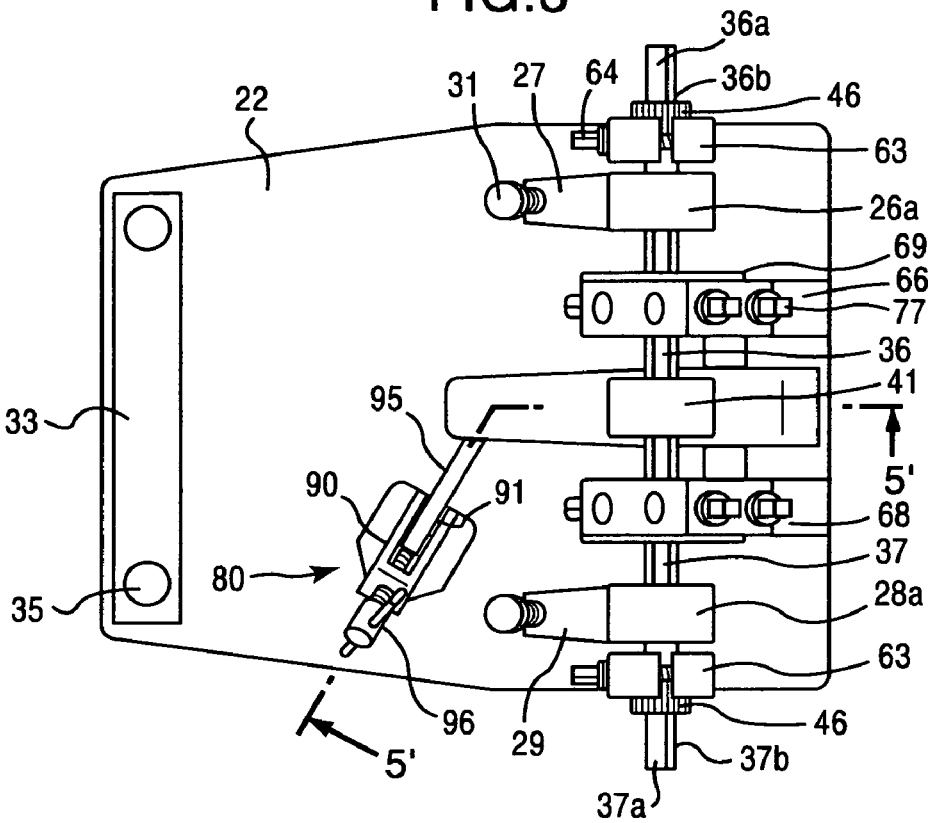
FIG. 3 is a top plan view of the drum beater assembly shown in FIG. 2.
Figure 4:
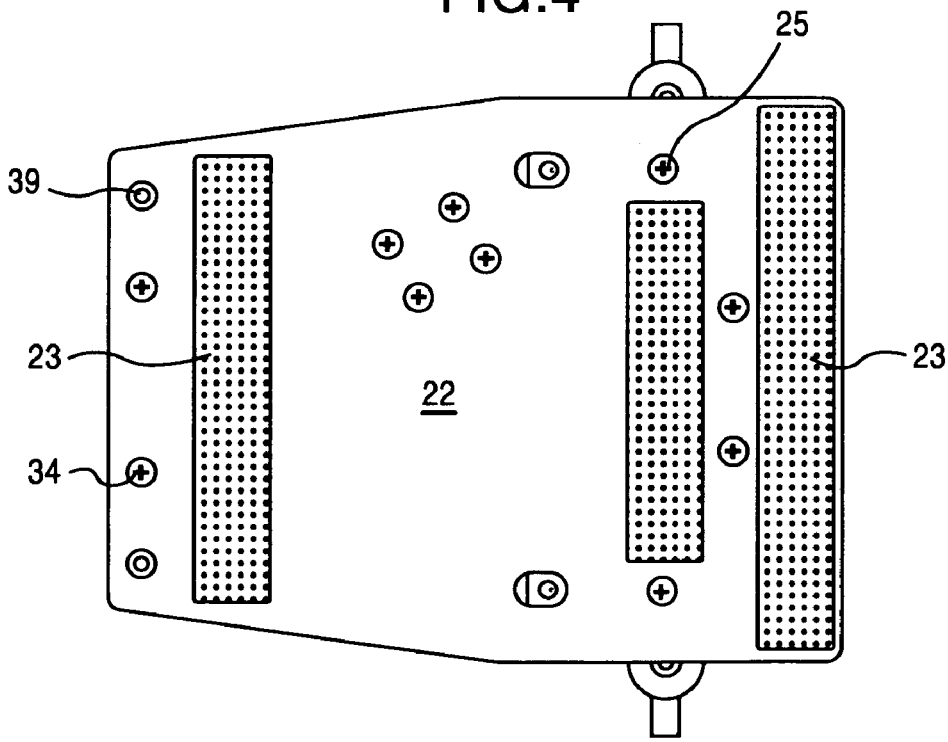
FIG. 4 is a bottom plan view of the base plate of the drum beater assembly shown in FIG. 2.
Figure 5:
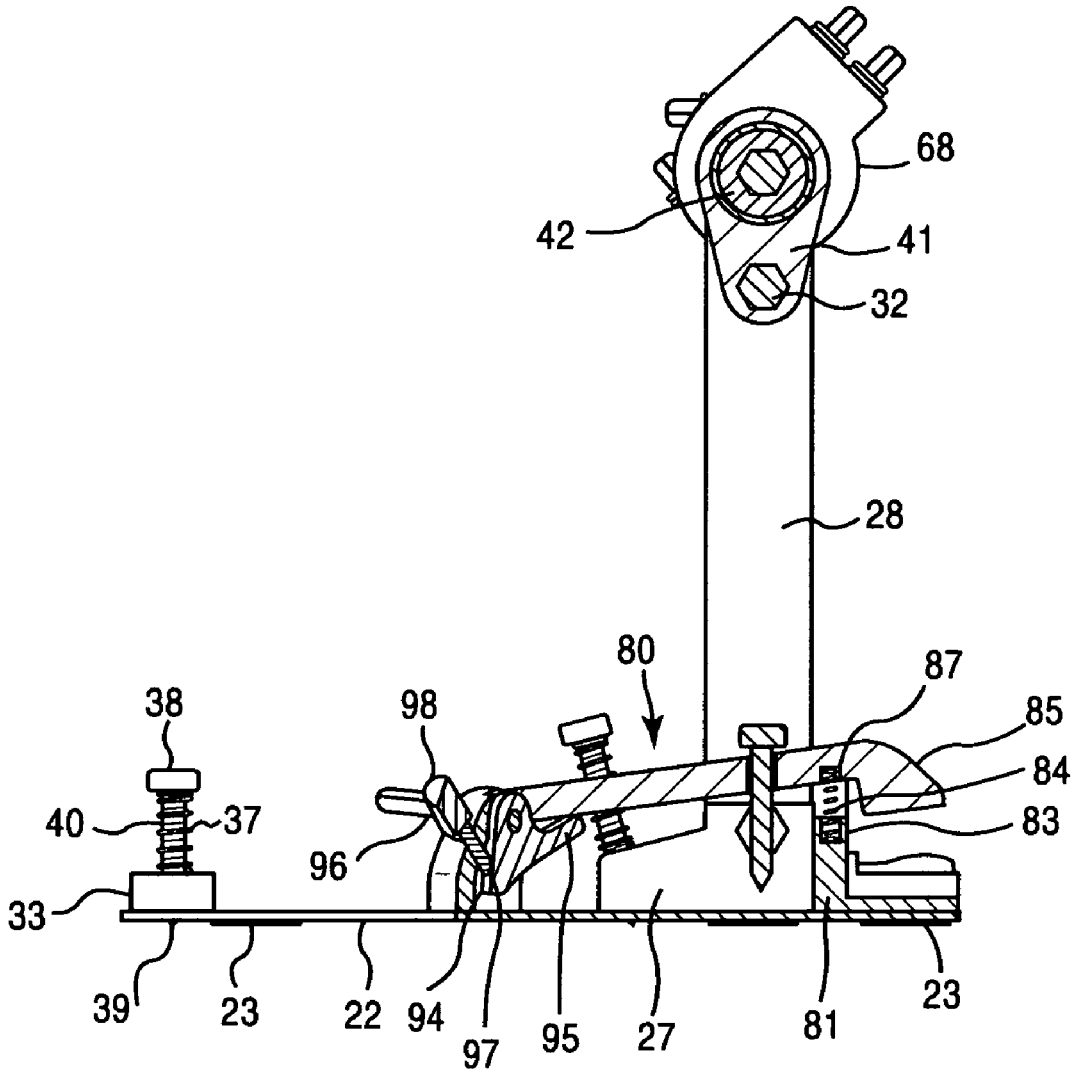
FIG. 5 is a side elevational view in partial cross sectional view taken along line 5' 5' shown in FIG. 3.

The beater assembly 20, as more clearly shown in FIGS. 2-4, is formed with a solid base plate 22 upon which an upright frame is mounted by screws 25. The bottom of the base plate 22 is provided with a plurality of skid strips 23 which keep the beater assembly 20 from moving when the beaters are driven via the action of pedal assemblies to strike the drum. The frame has two upright standards 26 and 28 having respective support feet 27 and 29 which are secured to the solid base plate 22 by screws 25 or other securing means. Each of the support feet 27 and 29 has a leveling assembly 31 moveably mounted thereto for leveling the base plate 22 on uneven surfaces. A leveling support bar 33 is secured to the top of the base plate 22 by screws 34. Two leveling assemblies 35 are mounted in the support bar 33. Each of the leveling assemblies 31 and 35 as more clearly seen in FIGS. 2, 3 and 5 are constructed with a threaded shank 37 which is screwed into a threaded bore formed in the respective support feet 27 and 29 and the support bar 33. The shank 37 has a knurled head 38 which allows the screw shank 37 to be screwed downward so that the distal tip 39 of the screw (see FIG. 4) raises or lowers that portion of the base plate 22 adjacent the respective leveling assembly. A spring 40 engages the under surface of the head 38 and the top surface of the support foot 27/29 or the top surface of the leveling support bar 33 to bias the screw outward away from the base plate 22.

Figure 6:
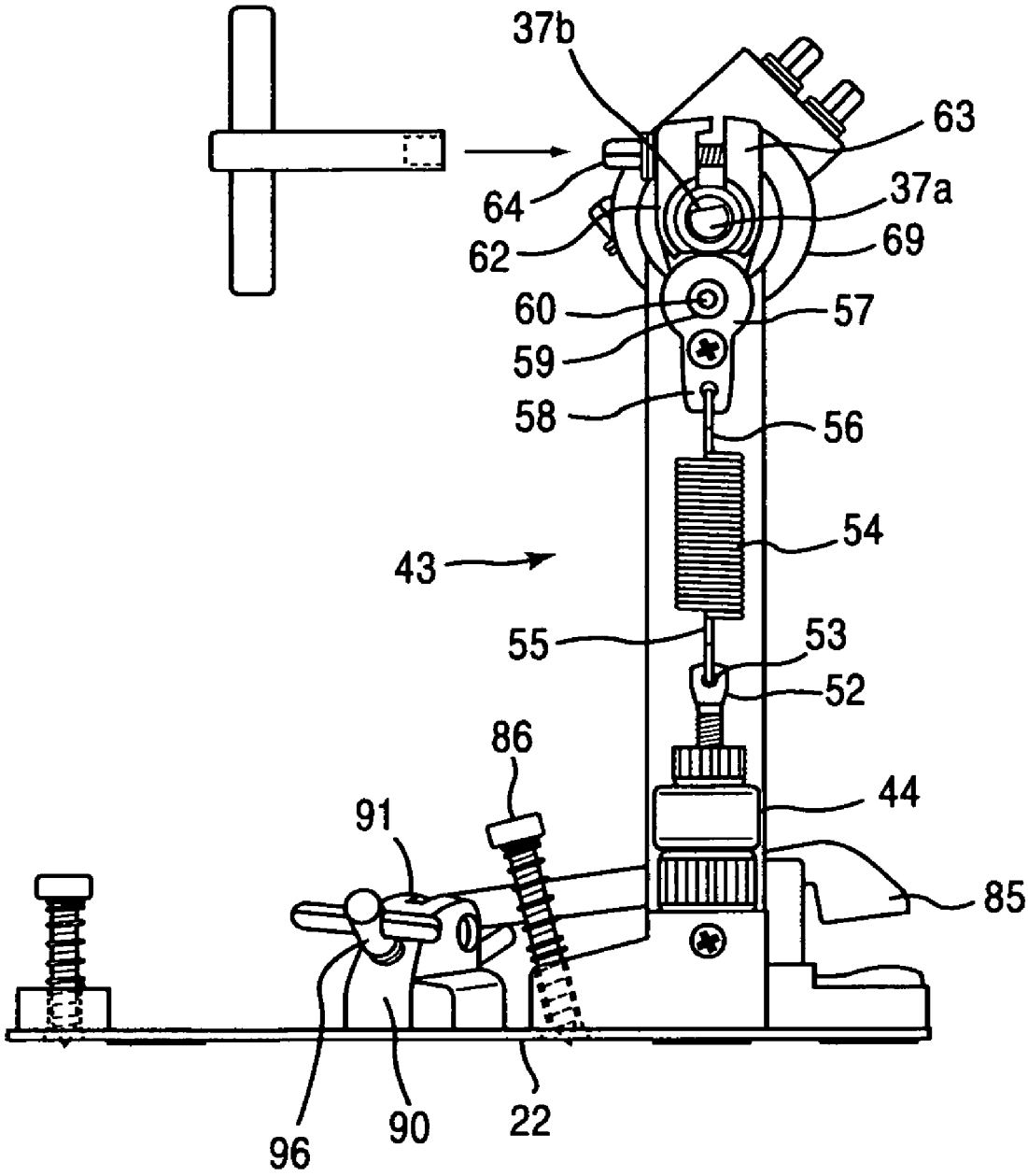
FIG. 6 is a side elevational view of the drum beater assembly shown in FIG. 2 with the keying mechanism shown in exploded view.

The upright standards 26 and 28 of the frame are spaced and supported by a lower cross support bar 30 and an upper cross support bar 32 which have their ends mounted to the upright standards 26 and 28 by screws. The screws are threaded in respective bores cut into the sides of the standards with the screws being threaded into the ends of the respective cross support bars 30 and 32. The upright standards 26 and 28 have a throughgoing bore drilled therethrough with an outer countersunk portion which allows the screw head to be inserted into the countersunk portion so that the screw head does not extend outside the exterior surface of the standard. A split shaft 36/37 is rotatably mounted in yokes or bearing housing 26(*a*) and 28(*a*) formed on the distal end of each of the standards 26 and 28 and a center bearing shaft support member 41 which is secured to upper cross support bar 32. As seen in FIG. 5 the upper portion of support member 41 has a throughgoing bore drilled there through which holds two coaxial bearing sleeves 42, one for shaft 36 and the other for shaft 37. Outer bearing sleeves 38 are coaxially mounted in respective yokes or bearing housings 26(*a*) and 28(*a*) and the coaxially aligned shafts 36/37 have one end mounted in the bearing sleeve 38 on one upright standard and the other end mounted in a bearing sleeve 42 mounted in the center support member 41. The bearing sleeve 42 is split into two sections so that each side rotates independently of the other side and shaft 36 can rotate independently of shaft 37. Each of shafts 36 and 37 are tensioned on their distal end extending outside the respective standard by a spring assembly 43 to return to a set position upon release of the respective transmitted pedal torque. The spring assembly 43 as most clearly seen in FIG. 6 which is the same on the beater assembly 20 and each pedal assembly 100 and 101, is mounted an eye member 44 integrally formed on the bottom section of standards 26 and 28 and extends outward therefrom and transverse thereto. Each eye member 44 is positioned above the foot 27/29 of each of the standards 26/28 and defines a throughgoing bore oriented perpendicular to the horizontal plane of the base plate 22. A serrated shaft mount member 46 as seen in FIG. 33 is mounted to shaft extension portions 36(*a*) and 37(*a*) of each of the shafts 36 and 37 by a set screw. Each shaft extension portion 36(*a*) and 37(*a*) is formed with a flat locking portion 36(*b*) and 37(*b*) as seen in FIG. 6.

The spring assembly 43 is constructed with an adjustable threaded eye anchor mechanism 52, a coil spring 54 having one end 55 looped to fit into the eye 53 of the eye anchor mechanism 52 with the other spring end 56 mounted through an aperture 58 cut into a pivotal shaft clamp coupler member 57. The pivotal shaft clamp coupler member 57 defines a throughgoing bore 59 which holds a pivot arm 60 of an adjustable clamp member 62. The pivot arm 60 rotates within bore 59. The adjustable clamp member 62 has two jaws 63 which can be tightened by a screw 64 around the serrated shaft mount member 46 thus allowing the beaters shafts to be selectively positioned to a desired orientation. The spring 54 returns the shaft and the mounted beater to a predetermined position after the torque generated by the pedal assembly is released.

Two concentric beater head mounts 66 and 68 (see FIGS. 6 and 10) are respectively fixedly mounted on the shafts 36 and 37. Each drive head is constructed with a stepped mounting collar 69 fixed to the shaft 36/37 by set screws and an adjustable clamping mount 70 rotatable on the stepped cylindrical collar 69. The clamping mount body 70 can be loosened from engagement with collar 69 with tightening screw 71 to rotatable clamping mount 70 to the desired position on the collar which is mounted to the shaft. The clamping mount body 70 defines a bore 73 which is adapted to hold a shaft 72 of a drum beater. The drum beater is constructed with a shaft 72 and a beater head 74 having a hard end portion 75 and a soft end portion 76 allowing the drummer to change the sound of the beat by positioning a specific head side to strike the drum. A cylindrical stop member 77 is mounted on each of the shafts 72 to allow the shaft to be inserted into the clamping mount bore 73 a predetermined distance. Each cylindrical stop member 77 has a throughgoing bore allowing a screw fastener to be inserted therein to engage the beater shaft 72 holding the cylindrical stop member in a fixed position on the shaft. The beater shaft 72 is held in fixed position within the bore 71 by threaded fasteners 77 as shown in FIG. 3.

A drum hoop clamp mechanism 80 as seen in FIGS. 2, 3, 5 and 6 is secured to the top of the base plate 22. The hoop clamp mechanism 80 is a center mounting hoop clamp which eliminates all lateral torque on the bass drum hoop. The hoop clamp mechanism 80 is constructed with a base member 81 secured to the base plate 22 by screws. The base member 81 forms a yoke having arms with a well 83 formed in the bottom of the U formed by the yoke to hold spring 84. The hoop locking clamp bar 85 which engages the drum rim is urged upward by spring 84 mounted in the base of the yoke which engages the bottom surface of the locking clamp bar 85 and is seated in well 87 formed in the bottom surface of locking clamp bar 85. The body of the locking clamp bar 85 also defines a threaded bore which receives a screw 86 which holds the locking clamp bar 85 in position over the yoke preventing lateral sliding of the locking clamp bar 85. The screw 86 is threaded into the lower cross support bar 30 as can be seen in FIG. 1. A locking bar adjustment mechanism 88 is mounted to the base plate 22 by screws and is offset on the plate 22 in relation to the axis of the locking clamp bar 85 to allow easy access and turning by the user. The locking bar adjustment mechanism 88 is constructed with a body 90 defining a slot 91 cut therein as seen in FIG. 3 and an axle member 92 mounted to the body as seen in FIG. 5 extending across the slot 91. A cam arm member 94 is pivotally mounted on the axle member 92. The cam member 94 has a curved extension arm 95 which engages the distal end portion undersurface of the locking clamp bar 85 allowing the distal end to be moved upward or downward against the action of spring 83 carried in the bottom section of the yoke engaging the distal portion of the locking clamp bar 85. A threaded driver 96 is mounted in a threaded bore cut in the body 90 with the end 97 of the driver 96 engaging and driving the cam member 94. When the driver head 98 is turned clockwise the driver is rotated causing the end 97 to engage the rear end surface of the cam 94 driving the curved extension arm 95 upward against the underside of the locking clamp bar 85 so that the proximal end of the locking clamp bar 85 is driven downward against the rim of the drum holding the drum in place. Conversely when the screw is rotated counterclockwise the pressure on the underside of the locking bar is released allowing the spring 83 to bias the distal end of the locking bar 85 upward allowing the rim of the drum to be disengaged.

Figure 8:
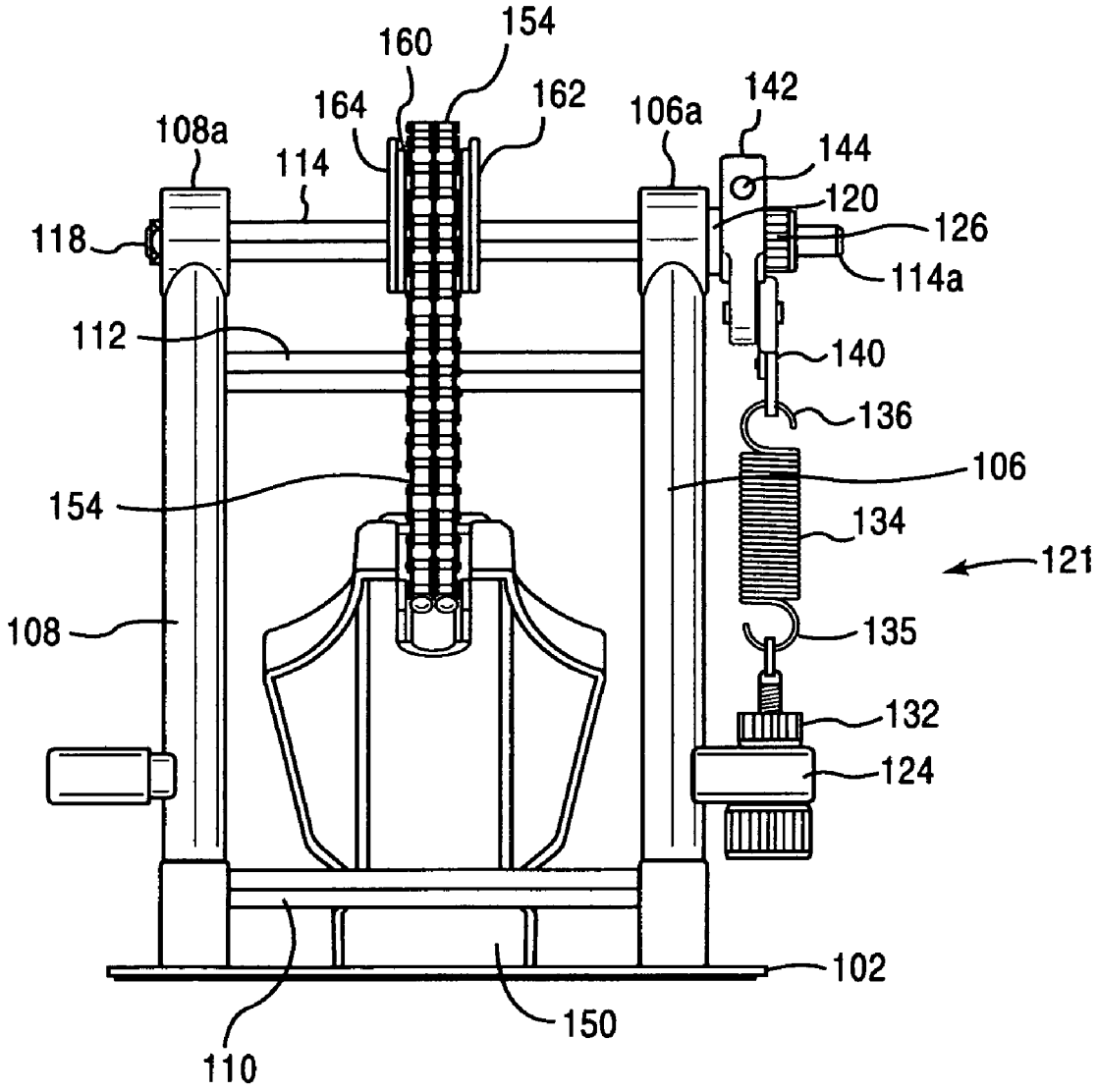
FIG. 8 is an enlarged rear elevational view of a pedal assembly shown in FIG. 1.
Figure 9:
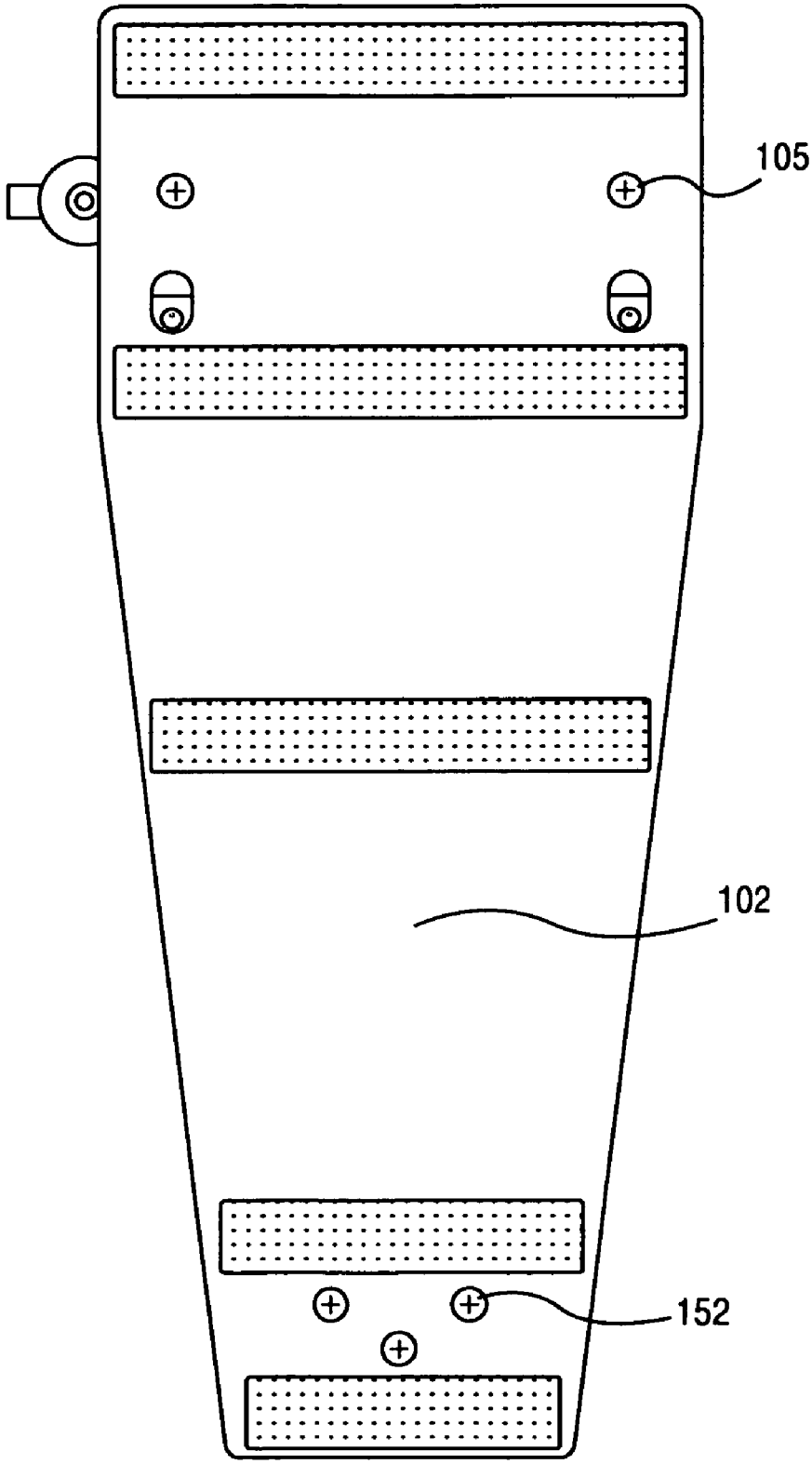
FIG. 9 is a bottom plan view of the pedal assembly base plate shown in FIG. 1.
Figure 10:
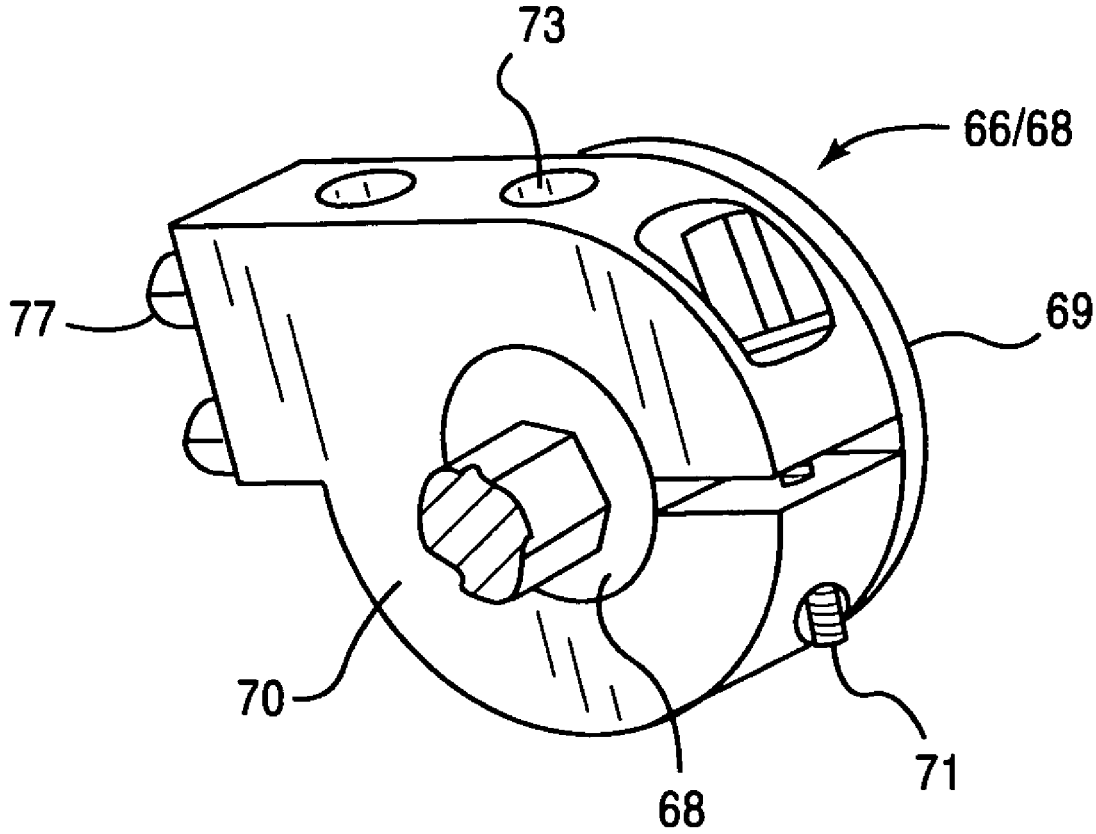
FIG. 10 is an enlarged perspective view of the beater rotatable clamping mount.

The left and right pedal assemblies 100 and 101 as shown in FIGS. 1, 8, and 9 are formed with a solid base plate 102 upon which a frame is mounted by screws 105 as shown FIG. 9. The frame has two upright standards 106 and 108 which are spaced and supported by a lower cross support bar 110 and an upper cross support bar 112 which have their ends mounted to the upright standards by screws which are threaded in a blind bore cut into each end of the respective cross support bar. The upright standards have a throughgoing bore drilled therethrough with an outer countersunk portion which allows the screw head to be inserted into the countersunk portion so that the screw head does not extend outside the standard. A shaft 114 is rotatably mounted in yoke 106(*a*) and 108(*a*) formed on the distal end of each of the standards 106 and 108. Bearing sleeves 118 are coaxially mounted in respective yokes 106(*a*) and 108(*a*) allowing rotation of the shaft 114. The shaft 114 is tensioned by a spring assembly 121 to return to a set position. The spring assembly 121 is mounted to an eye member 124 integrally formed with standard 106 and extending transverse thereto. A serrated shaft mount member 126 is fixedly mounted to a shaft extension portion 114*a* having a flat locking portion, the same as that shown in the beater assembly shaft.

The spring assembly 121 is constructed with an adjustable threaded eye anchor mechanism 132, a coil spring 134 having one end 135 looped to fit into the eye of the eye anchor mechanism with the other end of the spring 136 being mounted to an aperture cut into a pivoted shaft coupler member 140. The pivoted shaft coupler member 140 is in turn mounted on a shaft extending from an adjustable clamp member 142 which when tightened, engages and is fixed on serrated shaft mount member 126. The adjustable clamp member 142 is tightened by a fastener screw 144 which is threadably mounted across the jaws of the clamp member 142. These spring assemblies are constructed identical to the spring assemblies for the split beater shafts 36/37.

A pedal 146 with a toe stop member 147 is pivotally mounted at 148 on a fixed heel plate 150 which is secured by screws 152 to the base plate 102. The pedal 146 has its toe end mounted to a flexible coupling, such as a chain 154 which couples the forward toe end of the pedal 146 to a sprocket 150 which is preferably concentric fixedly mounted to shaft 114.

Figure 7:
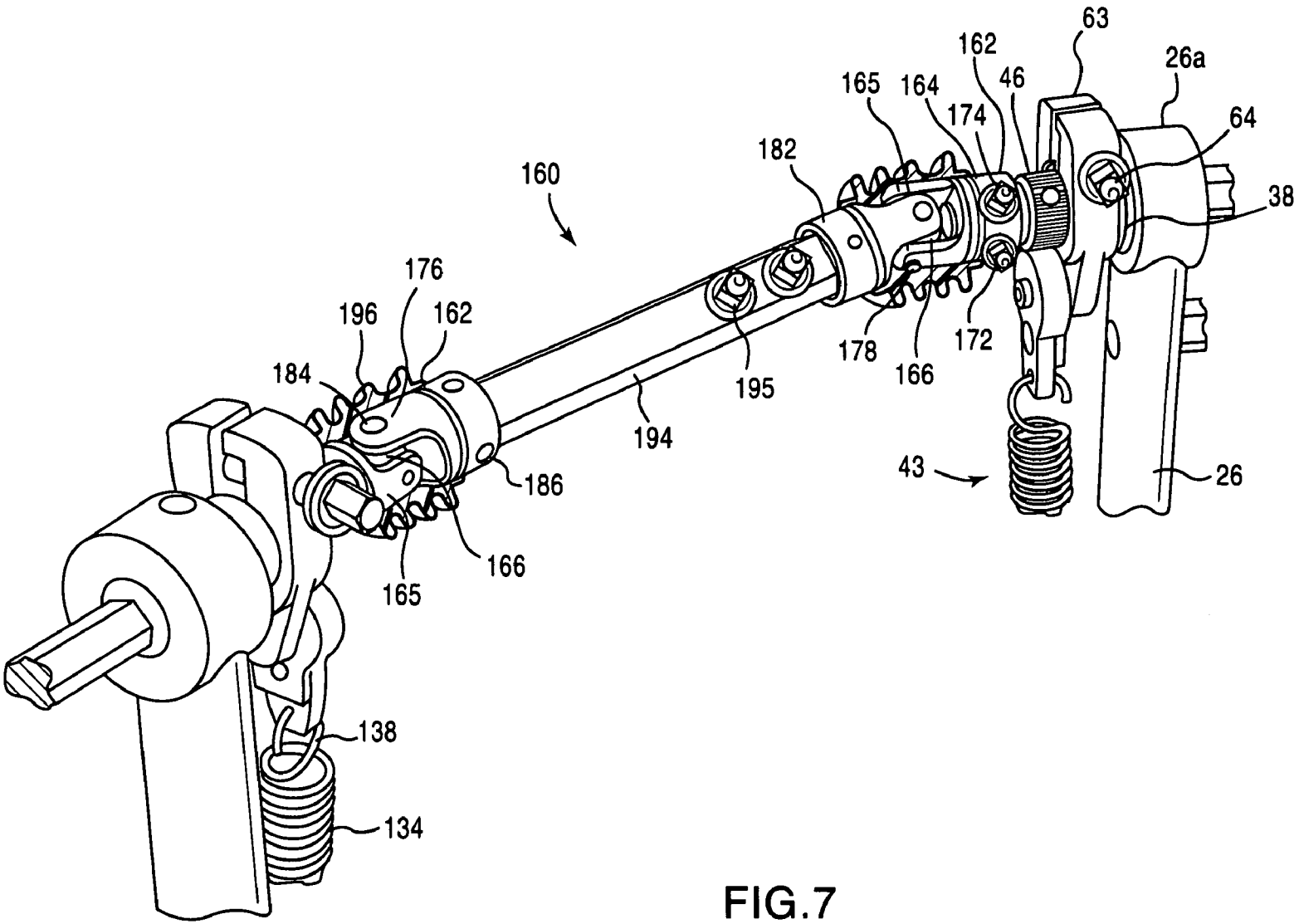
FIG. 7 is an enlarged perspective view of a connector assembly shown in FIG. 2 with the connector joint covering partially removed.

Each pedal assembly shaft 114 is flexibly connected to the respective beater shaft 36/37 by a movable connector assembly 160 which is more clearly shown in FIG. 7. The movable connector assembly 160 is constructed with end cylindrical member assemblies 162 at each end. The end cylindrical assemblies 162 operate in the same manner as a ball joint. Each end cylindrical member assembly has an outer cylindrical section 164 defining a centered throughgoing bore with an inner a yoke section 165 formed at the opposite end. The cylindrical section 164 has two angularly positioned threaded bores leading into the throughgoing bore which holds the end of shaft 114 or the ends of shafts 36 or 37. Set screws 172 and 174 are threadably mounted in the threaded bores and are tightened to allow the tips of the screws 172 to engage either the shaft extension portion 36(*a*) or 37(*a*) and shaft portion 114(*a*) holding the cylindrical member assembly 162 secured to the respective shaft extension portion. The opposite end of the outer cylindrical member as noted is formed with a yoke 165 across which pin means 178 is mounted to hold rotator member 166. The rotator member 166 which is in the form of a cylinder with opposing flat sided surfaces is mounted in the saddle of the yoke on the pin means 178 and is rotatable around the pin means 178. The rotatable member 166 has two opposing blind bores in the flat sided surfaces positioned transverse to the axis of pin 178 to hold pin means 184 allowing the attachment of a yoke of a second cylindrical inner member assembly 182. The second inner cylindrical member assembly 182 is shaped identical to outer cylindrical member 165 and is also mounted to the rotator member 166 by pin means 184 which extends through yoke 176 of the inner cylindrical member transverse to the axis of pin means 178. The yokes 165 and 178 are rotated around the rotator member 166 from each other so that the yoke arms of each cylindrical member assembly extend into the saddle of the other yoke section. This allows the outer cylindrical member and inner cylindrical member to be moved with respect to each other. The cylindrical section 182 of the inner cylindrical member also is provided with a central bore and two angularly position threaded bores to hold set screws 186 allowing the same to be secured to a connector bar (not shown). The connector bar is slidably mounted within sleeve 194. The connector bar is secured at the length desired within sleeve 194 by screws 195. Thus the length of the connector assembly 160 can be selectively adjusted. The yokes and rotator member 166 of the cylindrical member assemblies 162 and 182 are covered with a rubber accordion cover 196 protecting the moving parts from dirt and foreign material.

In operation of the drum pedal device the hoop clamp 85 is mounted to the rim of a drum of a drum by turning the offset cam assembly mounted to the base plate 22. The beater shafts 72 are mounted in the beater mounts 66/68 with the beater arm 72 length being adjusted by cylindrical locking stop 77 and locked in place on the respective beater mount. The beater head is positioned so that either the soft portion 76 or the hard portion 75 strikes the drum skin. The pedal assemblies 100 and 101 are positioned on opposite sides of the drum beater assembly and the shafts 114 of same are connected with the respective split shafts 36/37 of the drum beater assembly by connector assemblies 160. Thus the connector assemblies 160 are secured to one end of the pedal rotating shaft 114 and the other end to the respective extending end of the split shaft 36/37. The drummer's depression of the pedal 146 pulls down on linkage 154 driving the sprocket 160 and shaft 114 upon which the sprocket is mounted. The end of the shaft 114(*a*) is connected to a connector assembly 160 which transmits the torque to one or the split shafts 36/37 of the beater assembly to rotate the respective shaft and the beater mount 70 which is secured to shaft 36/37 causing the beater head 74 to strike the drum skin. The beater heads can be operated independently or in unison by the drummer by selective operation of the respective foot pedals 146.

The principles, preferred embodiments and modes of operation of the present invention have been described in the foregoing specification. However, the invention should not be construed as limited to the particular embodiments which have been described above. Instead,. the embodiments described here should be regarded as illustrative rather than restrictive. Variations and changes may be made by others without departing from the scope of the present inventions defined by the following claims.

What is claimed is:

1. A dual drum pedal assembly comprising:

a beater assembly and a plurality of separate pedal assemblies positioned away from said beater assembly and connected to said beater assembly to operate said beater assembly;

said beater assembly comprising a base plate adapted to sit on the floor having an outer end adapted to be juxtaposed with a drum; a plurality of plate leveling devices mounted to said base plate, a frame including a plurality of upright posts mounted to said base plate; bearing means mounted to upper ends of said upright posts; and a split shaft having shaft sections journaled in said bearing means, said split shaft allowing for independent rotation of each shaft section by said separate pedal assemblies;

a plurality of beater mechanisms mounted on said split shaft;

a connector assembly linking each pedal assembly to said beater assembly for rotation of the beater assembly split shaft; and each pedal assembly comprising a base plate, a pedal pivotally mounted on said base plate, a frame with at least two upright standards mounted to and extending upward from said base plate and a drive shaft rotatably mounted in said frame upright standards, a sprocket mounted on said drive shaft and flexible drive means mounted to said sprocket and said pedal so that depression of said pedal rotates said sprocket and associated drive shaft.

2. The dual drum pedal assembly as claimed in claim 1 wherein said beater assembly base plate has at least one anti-skid mechanism mounted on its bottom surface.

3. The dual drum pedal assembly as claimed in claim 1 wherein said beater mechanism comprises an adjustable beater mount with variable positioning means mounted on said shaft means and a beater shaft with a beater head mounted in said beater mount,said beater head having two opposing end surfaces for striking a drum, one head surface being of a harder composition than the other beater head surface.

4. A drum pedal assembly comprising:

a beater assembly comprising a beater base plate adapted to sit on the floor and having an outer end adapted to be juxtaposed with a drum, a plurality of upright posts mounted on said base plate, at least one cross member secured to said upright posts and a beater shaft means rotatably mounted to said upright posts and a central support member secured to a cross member;

said beater shaft means comprising a split shaft having a pair of coaxial shaft parts with outer ends journaled in bearings housed in said upright posts and axially juxtaposed inner ends journaled in bearing means housed in said central support member and a drum beater mounted on each of said coaxial shafts;

a plurality of pedal assemblies positioned away from opposite sides of said beater assembly connected to said beater assembly by connector means, each pedal assembly comprising a pedal pivotally mounted on a separate base plate;

a pair of posts having upper and lower ends with the lower ends mounted on said pedal assembly base plate;

bearings housed in the upper ends of said pedal assembly posts, a shaft rotatably mounted in said bearings; and a drive linkage mounted to one end of said pedal connecting the pedal to a concentric sprocket mounted to said shaft for rotation of the shaft on depression of the pedal; and said connector means connecting said pedal assembly shaft with said beater shaft means to transmit torque from said pedal shaft to said beater shaft means.

5. The drum pedal assembly as claimed in claim 4 wherein said linkage is a chain.

6. The drum pedal assembly as claimed in claim 4 wherein spring means engages said pedal shaft and said beater shaft means,said spring means comprising an eyelet member mounted to said post, a spring having one end mounted to an adjustable anchor mechanism mounted to said eyelet member and the other end mounted to a rotatable connector member, said rotatable connector member being mounted to an adjustable shaft mounting member.

7. The drum pedal assembly as claimed in claim 4 wherein said drum beater has a head with two opposed end surfaces for striking a drum, one head surface being of a harder composition than the other beater head surface.

8. The drum pedal assembly as claimed in claim 4 wherein said connector means comprises an outer connector member mounted at both ends of a connector shaft, fastening means to connect said outer connector member to said shaft,and a drive shaft connector member movably mounted to said outer connector member, said outer connector member and said drive shaft connector member being connected by a flexible sleeve.

9. A drum pedal assembly comprising:

a beater assembly, said beater assembly comprising a base plate adapted to sit on the floor with one end adapted to be juxtaposed with a drum, upright posts mounted on said base plate, a cross member mounted to said upright posts and a shaft means rotatably mounted to said upright supports;

said shaft means comprising a shaft having a pair of coaxial shaft sections which can rotate independently of each other, said shaft sections having outer ends journaled in a bearings mounted in one of said upright posts and axially juxtaposed inner ends journaled in a central support member supported by a cross member between said posts and a drum beater mounted on each of said coaxial shaft sections;

adjustable spring means rotatably biasing said shaft means mounted to one end of said shaft means causing said shaft means and its associated drum beater to return to a predetermined position;

a pedal assembly, said pedal assembly comprising a pedal pivotally mounted on a separate base plate;

a pair of posts having upper and lower ends,said posts being mounted on said base plate;

bearings housed in the post upper ends, a pedal shaft rotatably mounted in said bearing on the post upper ends;

a drive sprocket secured to said pedal shaft;

a linkage mounted to said pedal and to said shaft sprocket for rotation of the pedal shaft on depression of the pedal and adjustable spring means mounted to one of said posts and said pedal shaft rotatably biasing said pedal shaft to return said pedal to a predetermined position; and a connector assembly connecting said pedal shaft with said beater shaft means.

10. The drum pedal assembly as claimed in claim 9 wherein hoop mounting means are mounted said beater base plate, said hoop mounting means comprising a moveable hoop clamp and a cam mechanism engaging and operating said hoop clamp, said cam mechanism comprising a cam which is engaged by drive means.

11. The drum pedal assembly as claimed in claim 9 wherein said spring means comprises an eyelet member mounted to at least one of said upright posts, a spring having one end mounted to anchor means which is mounted to said eyelet member and the other end mounted to a rotatable connector member, said rotatable connector member being mounted to an adjustable shaft mounting member.

12. The drum pedal assembly as claimed in claim 9 wherein said beater base plate and said pedal base plate have anti-skid means secured on their bottom surface and leveling means mounted on said base plate.

13. The drum pedal assembly as claimed in claim 9 including a beater mechanism mounted on said shaft means, said beater mechanism comprising an adjustable beater mount, a beater arm removably mounted to said beater mount and a beater head secured to the distal end of said beater arm, said beater head being provided with opposite end surfaces of different hardness to provide different sound qualities when striking a drum.

14. A dual drum pedal assembly comprising:

a beater assembly and a plurality of pedal assemblies connected to said beater assembly to operate said beater assembly;

said beater assembly comprising a base plate adapted to sit on a floor having an outer end adapted to be juxtaposed with a drum; a drum hoop lock assembly mounted on said base plate to operate a hoop lock locking a drum rim to said beater assembly, a frame including a plurality of upright posts mounted to said base plate; bearing means mounted to upper ends of said upright posts; and a shaft means having a plurality of shaft sections journaled in said bearing means, said shaft means allowing for independent rotation of each shaft section by separate pedal assemblies;

a plurality of beater mechanisms mounted on said shaft means;

a connector assembly linking a pedal assembly to said beater assembly for rotation of the beater assembly shaft means; and each pedal assembly comprising a base plate, a pedal pivotally mounted on said base plate, a frame comprising a plurality of upright posts with bearing assemblies, said posts mounted to and extending upward from said base plate and a drive shaft rotatably mounted in said frame bearing assemblies, a sprocket mounted on said drive shaft and flexible drive means mounted to said sprocket and said pedal so that depression of said pedal rotates said sprocket and associated drive shaft.

15. The dual drum pedal assembly as claimed in claim 14 wherein said hoop lock assembly comprises a moveable locking bar mounted to said frame and cam means offset from said locking bar mounted to said base plate, said cam means adapted to engage said locking bar and move said locking bar to a position engaging the rim of a drum.

16. A dual drum pedal assembly comprising:

a beater assembly and a plurality of pedal assemblies connected to said beater assembly to operate said beater assembly;

said beater assembly comprising a base plate adapted to sit on a floor and having an outer end adapted to be juxtaposed with a drum;

a frame including a plurality of upright posts mounted to said base plate;

bearing means mounted to upper ends of said upright posts;

a shaft means having a plurality of shaft sections journaled in said bearing means, said shaft means allowing for independent rotation of each shaft section by separate pedal assemblies; spring means rotationally biasing said shaft means mounted to an end of said shaft means, said spring means comprising an eyelet member mounted to at least one of said upright posts, a spring tension adjustment assembly mounted to said eyelet member, a spring having one end mounted to said spring tension adjustment assembly and the other end mounted to a rotatable connector member, said rotatable connector member being mounted to an adjustable shaft mounting member;

a plurality of beater mechanisms mounted on said shaft means;

a connector assembly linking a pedal assembly to said beater assembly for rotation of the beater assembly shaft means; and each pedal assembly comprising a base plate, a pedal pivotally mounted on said base plate, a frame extending upward from said base plate and a drive shaft rotatably mounted in said frame, a sprocket mounted on said drive shaft and flexible drive means mounted to said sprocket and said pedal so that depression of said pedal rotates said sprocket and associated drive shaft.

* * * * *